US009156282B2

(12) United States Patent
Yamasaki

(10) Patent No.: US 9,156,282 B2
(45) Date of Patent: Oct. 13, 2015

(54) NAIL PRINT APPARATUS AND PRINTING METHOD THEREOF

(71) Applicant: CASIO COMPUTER CO., LTD., Shibuya-ku, Tokyo (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/210,395

(22) Filed: Mar. 13, 2014

(65) Prior Publication Data

US 2014/0267517 A1 Sep. 18, 2014

(30) Foreign Application Priority Data

Mar. 14, 2013 (JP) ..... 2013-051166

(51) Int. Cl.
*B41J 3/407* (2006.01)

(52) U.S. Cl.
CPC ..... *B41J 3/4073* (2013.01)

(58) Field of Classification Search
CPC ..... B41J 3/4073
USPC ..... 347/101, 107–109
See application file for complete search history.

(56) References Cited

U.S. PATENT DOCUMENTS

| | | | | |
|---|---|---|---|---|
| 6,035,860 | A * | 3/2000 | Mombourquette | 132/200 |
| 6,286,517 | B1 * | 9/2001 | Weber et al. | 132/73 |
| 6,336,694 | B1 * | 1/2002 | Ishizaka | 347/2 |
| 8,721,068 | B2 | 5/2014 | Yamasaki | |
| 2004/0194648 | A1 | 10/2004 | Uchida | |
| 2009/0153604 | A1 * | 6/2009 | Chen et al. | 347/9 |
| 2011/0304877 | A1 * | 12/2011 | Bitoh | 358/1.15 |
| 2011/0315027 | A1 * | 12/2011 | Bitoh | 101/35 |
| 2012/0147107 | A1 * | 6/2012 | Bitoh | 347/101 |

FOREIGN PATENT DOCUMENTS

| | | |
|---|---|---|
| JP | 2004-216872 | 8/2004 |
| JP | 2006130052 A | 5/2006 |
| JP | 2012135600 A | 7/2012 |

OTHER PUBLICATIONS

Japanese Office Action dated Jul. 21, 2015 issued in counterpart Japanese Application No. 2013-051166.

* cited by examiner

*Primary Examiner* — Manish S Shah
*Assistant Examiner* — Roger W Pisha, II
(74) *Attorney, Agent, or Firm* — Holtz, Holtz, Goodman & Chick PC

(57) ABSTRACT

A nail print apparatus, including: a nail placement unit on which a central area in a protruding portion of a nail of a finger or a nail of a toe is placed, the protruding portion of the nail is an area that protrudes from a distal portion of the finger or the toe and the central area includes a center of the protruding portion in a width direction of the nail; and a print head which performs printing on the nail that the central area is placed on the nail placement unit.

7 Claims, 11 Drawing Sheets

NAIL PRINT APPARATUS AND PRINTING METHOD THEREOF

CROSS-REFERENCE TO RELATED APPLICATIONS

The entire disclosure of Japanese Patent Application No. 2013-051166 filed on Mar. 14, 2013 including description, claims, drawings, and abstract are incorporated herein by reference in its entirety.

BACKGROUND OF THE INVENTION

1. Field of the Invention

The present invention relates to a nail print apparatus and a printing method thereof.

2. Description of Related Art

Conventionally, there have been known nail print apparatuses which print desired nail designs on fingernails of people.

By using such apparatus, nail print can be enjoyed easily without visiting nail salons and such like.

As such nail print apparatus, a print apparatus which fixes a finger of a nail to be printed and performs printing by using a pad for transferring ink is described in Japanese Patent Application Laid Open Publication No. 2004-216872, for example.

However, when nail printing is performed on the nail, fine printing cannot be performed unless the height of the nail and the height of a print head have a predetermined positional relationship therebetween and the distance between the nail and the print head is a value suitable for the printing. However, the thickness of a finger, the width of a nail and the degree of curvature of a nail vary according to individual and the type of finger.

Thus, in order to perform fine printing, the finger conventionally needs to be adjusted to the height suitable for printing and fixed by using a jig or such like. This is a troublesome work.

Furthermore, when recognizing the position and shape of a nail to be printed for confirming a print range, the nail is photographed with a camera from above to obtain a nail image. However, in such method, an error occurs in the form recognition when the distance between the camera and the nail varies.

That is, when the camera is relatively close to the nail, the nail is recognized as larger than its actual size and the print range may be out of the nail.

On the other hand, when the camera is relatively away from the nail, the nail is recognized as smaller than its actual size and there may be uncoated area.

Thus, there is considered a method such as sensing of information in the height direction and feeding back the information to a mechanism which recognizes the nail shape and such like.

However, such method needs a sensing mechanism which senses information in the height direction. Thus, the apparatus becomes larger, leading to the rise of apparatus cost.

SUMMARY OF THE INVENTION

An object of the present invention is to provide a nail print apparatus and a printing method thereof which can maintain a fixed position in the height direction of a nail regardless of the thickness of a finger, width of the nail and the degree of curvature of the nail and perform fine printing on the nail by a simple procedure.

In order to solve the above object, according to one aspect of the present invention, there is provided a nail print apparatus, including: a nail placement unit on which a central area in a protruding portion of a nail of a finger or a nail of a toe is placed, the protruding portion of the nail is an area that protrudes from a distal portion of the finger or the toe and the central area includes a center of the protruding portion in a width direction of the nail; and a print head which performs printing on the nail that the central area is placed on the nail placement unit.

According to another aspect of the present invention, there is provided a printing method of a nail print apparatus, including: placing a central area in a protruding portion of a nail of a finger or a toe on a nail placement unit, the protruding portion of the nail being an area which protrudes from a distal portion of the finger or the toe and the central area including a center of the protruding portion in a width direction of the nail; and performing printing on the nail that the central area is placed on the nail placement unit by a print head.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENT

Figure 1:
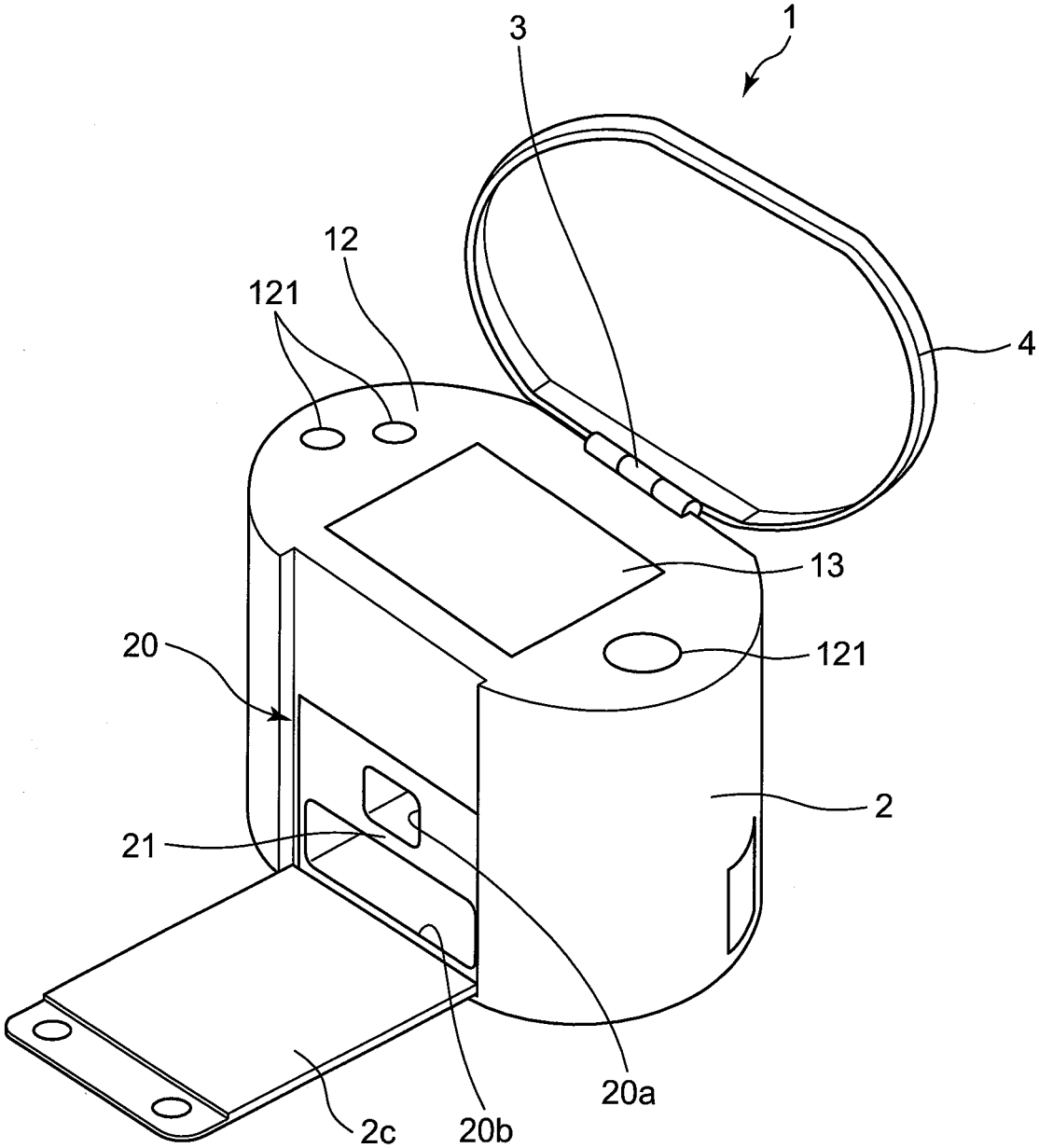
FIG. 1 is a perspective view conceptually showing a nail print apparatus according to an embodiment which shows a state where a cover is open.

Hereinafter, a nail print apparatus and a printing method thereof according to the present invention will be described in detail by showing embodiments.

With reference to FIGS. 1 to 11, an embodiment of a nail print apparatus according to the present invention will be described.

Though the after-mentioned embodiment is provided with various technically preferred limitations to perform the present invention, the scope of the present invention is not limited to the following embodiment and illustrated examples.

In the following embodiment, the nail print apparatus performs drawing on a fingernail of a hand as a drawing target. However, the drawing target of the present invention is not limited to the fingernail of hand. The drawing target may be a nail of a toe.

FIG. 1 is a perspective view showing an outer appearance of the nail print apparatus in the embodiment.

Figure 2:
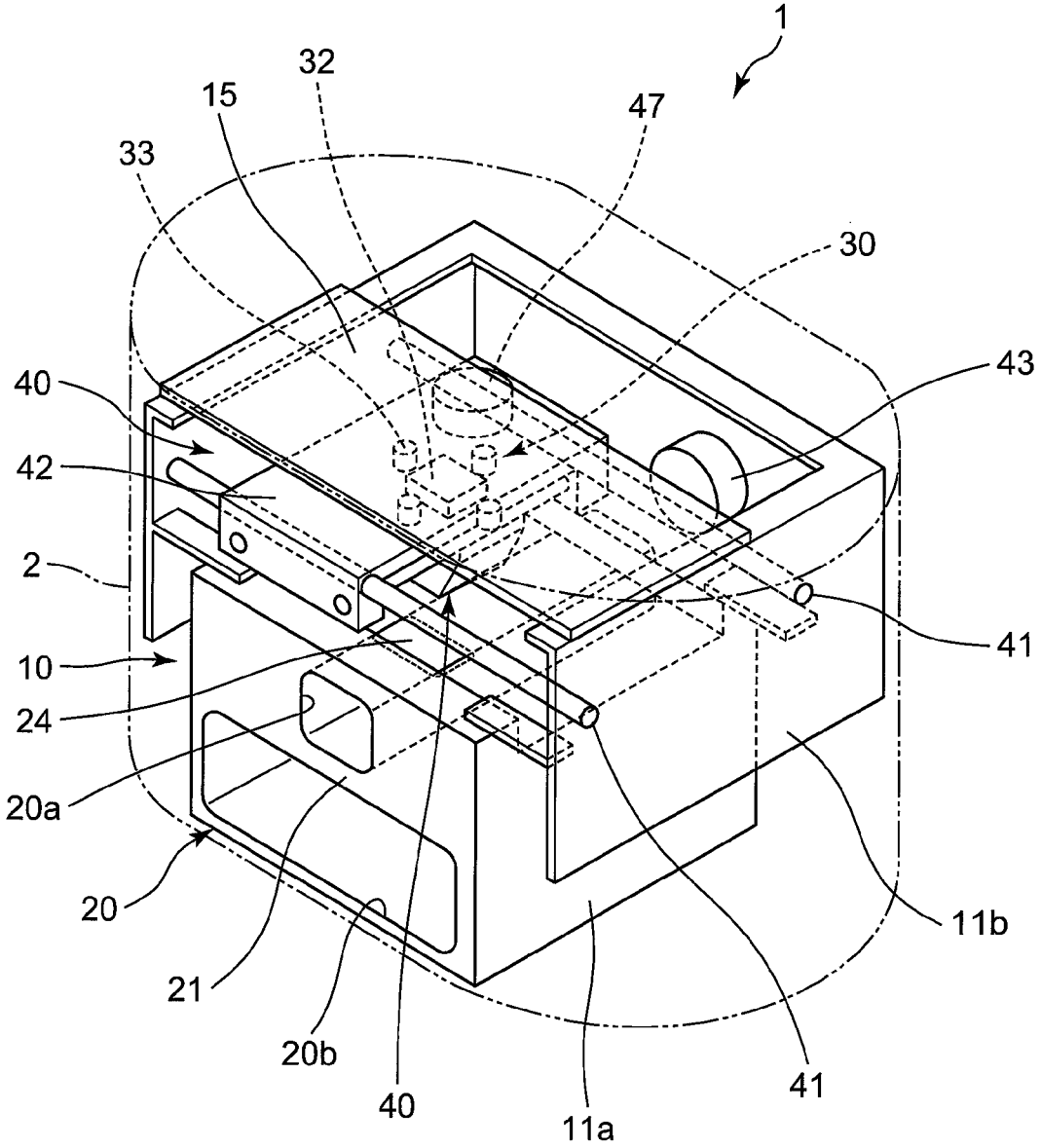
FIG. 2 is a perspective view conceptually showing an apparatus main body of the nail print apparatus of FIG. 1.

FIG. 2 is a perspective view showing an internal configuration of the nail print apparatus.

As shown in FIG. 1, the nail print apparatus 1 includes a case main body 2 and a cover 4.

The cover 4 is connected to the case main body 2 so as to be rotatable via a hinge 3 provided at a rear end portion on the upper surface (top plate) of the case main body 2.

The cover 4 is rotatable from a state of lying on the top plate of the case main body 2 to a state (see FIG. 1) of being vertically provided with respect to the top plate of the case main body 2 with the hinge 3 as the supporting point.

The case main body 2 is formed in a nearly oval shape in a plan view from above.

An opening/closing plate 2*c* is provided at the front side of the case main body 2 so as to be able to flip up and down.

The opening/closing plate 2*c* is joined to the case main body 2 via a hinge (not shown in the drawings) which is provided at the lower end portion of the front surface of the case main body 2. The opening/closing plate 2*c* is for opening and closing the front surface of the case main body 2. When performing printing on a nail T, the opening/closing plate 2*c* is flipped down as shown in FIG. 1 and the front surface of the case main body 2 is open. On the other hand, when printing is not performed on the nail T, the opening/closing plate 2*c* is flipped up and the front surface of the case main body 2 is closed.

The shapes and configurations of the case main body 2 and the cover 4 are not limited to the examples illustrated here.

An operation unit 12 is set on the upper surface (top plate) of the case main body 2.

The operation unit 12 is for performing various input by a user.

The operation unit 12 is provided with a power switch button to turn on the nail print apparatus 1, a stop switch button to stop an operation, a design selection button to select a design image to be printed on a nail T, a print start button to instruct the print start and operation buttons 121 for performing various types of input, for example.

A display unit 13 is set at a nearly central portion of the upper surface (top plate) of the case main body 2.

The display unit 13 is configured by including a liquid crystal display (LCD), an organic electroluminescent display or other flat display, for example.

In the embodiment, on the display unit 13, an image (hereinafter, called "finger image") obtained by photographing a printing finger U1, a nail image (image such as the outline of a nail T) included in the finger image, a design selection screen for selecting a design image to be printed on the nail T, thumbnail images for design confirmation, instruction screens for displaying various instructions, a notification screen and an alarm screen are appropriately displayed, for example.

A touch panel may be integrally formed on the surface of the display unit 13. In such case, it is configured so that various types of input can be carried out also by a touching operation of touching the surface of the display unit 13 with a stylus pen (not shown in the drawings) or a fingertip, the stylus pen being a writing tool of sharpened stick and writing down by being pressed against the touch panel surface, for example.

An apparatus main body 10 of the nail print apparatus 1 is contained in the case main body 2.

Figure 3:
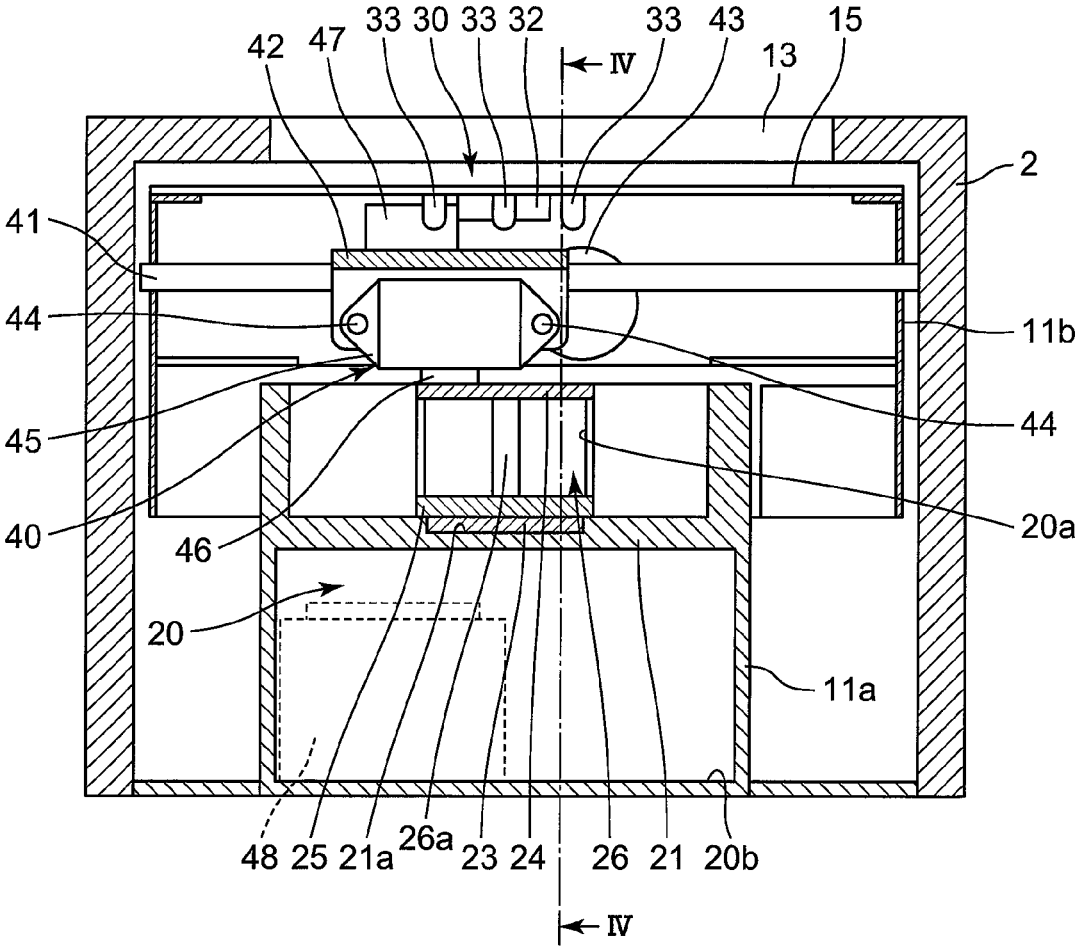
FIG. 3 is a sectional view of the front side of the nail print apparatus of FIG. 1.

FIG. 3 is a front view of the apparatus main body in the embodiment.

Figure 4:
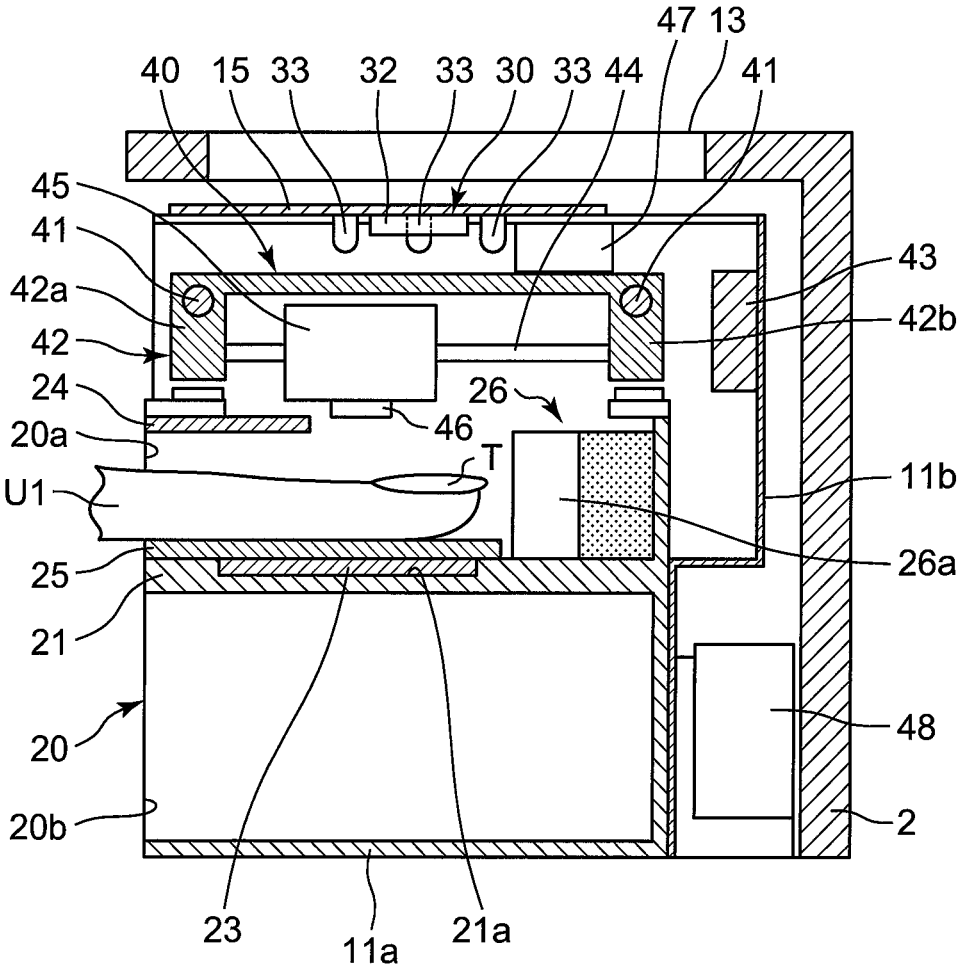
FIG. 4 is a sectional view of FIG. 3 cut along the line IV-IV.

FIG. 4 is a sectional view showing a cross-section surface cut along the line IV-IV shown in FIG. 3 and seen from the arrow direction.

As shown in FIGS. 2 to 4, the apparatus main body 10 is formed in a nearly box shape.

The apparatus main body 10 includes a lower machine casing 11*a* which is set at the lower section in the case main body 2 and an upper machine casing 11*b* which is set above the lower machine casing 11*a* and at the upper section in the case main body 2.

Then, the lower machine casing 11*a* and the upper machine casing 11*b* are provided with a printing finger fixing unit 20, a photographing unit 30, a printing unit 40, a control device 50 (see FIG. 9) and such like.

The printing finger fixing unit 20 is provided in the lower machine casing 11*a*.

That is, the lower machine casing 11*a* is provided with a printing finger inserting unit 20*a* and a non-printing finger inserting unit 20*b* which form the printing finger fixing unit 20.

The printing finger inserting unit 20*a* is a finger inserting unit for inserting a finger (hereinafter, called "printing finger U1") corresponding to a nail T which is a target of printing (see FIG. 4). The non-printing finger inserting unit 20*b* is a finger inserting unit for inserting fingers (hereinafter, called "non-printing fingers") other than the printing finger.

The printing finger inserting unit 20*a* is divided from the non-printing finger inserting unit 20*b* by a dividing wall 21.

In the embodiment, a case where a printing finger U1 is inserted into the printing finger inserting unit 20*a* one by one to perform printing on a nail T is described as an example.

Though the shape, size and such like of the printing finger inserting unit 20*a* are not especially limited, the printing finger inserting unit 20*a* is formed in a shape and size that are not tight even when an adult thumb or such like is inserted so as to treat various types of fingers.

A finger pressing unit 24 which regulates the position in the height direction of the printing finger U1 is provided at the upper section in the printing finger inserting unit 20*a*.

The finger pressing unit 24 is a plate member.

When the printing finger U1 is lifted up, the upper surface of the printing finger U1 is pressed against the lower surface of the plate member of the finger pressing unit 24.

Figure 11A:
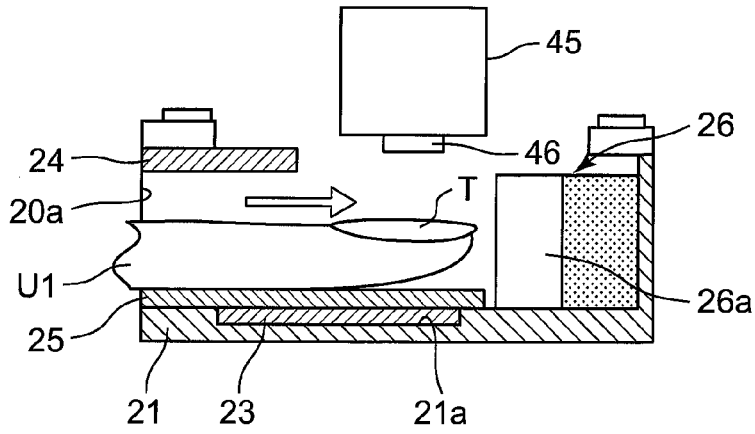
FIG. 11A is a main part sectional view showing a state where a printing finger is placed on a finger placement unit.
Figure 11B:
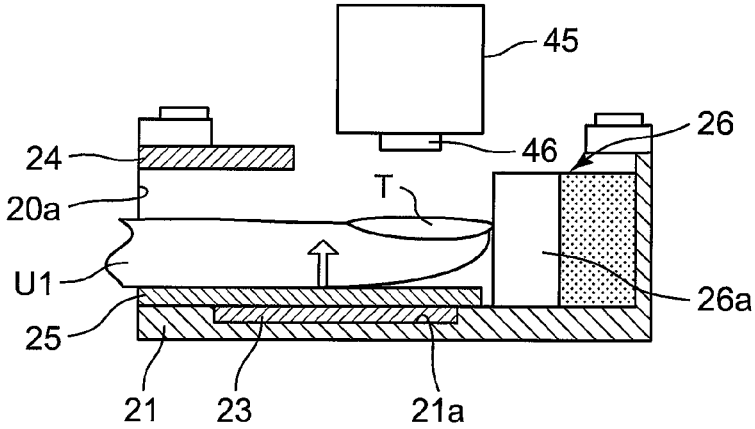
FIG. 11B is a main part sectional view showing a state where the printing finger shown in FIG. 11A is inserted to the back.
Figure 11C:
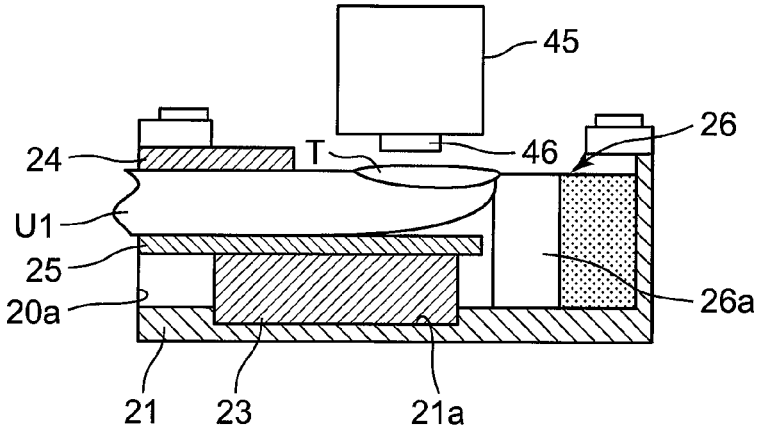
FIG. 11C is a main part sectional view showing a state where the upper surface of the printing finger is pressed against a finger pressing unit and the tip of the nail is placed on the nail placement unit.

Thus, positioning in the height direction of the printing finger U1 when the printing finger U1 is lifted up is performed so that the printing finger U1 is not lifted up too much (see FIG. 11C, for example).

A finger placement unit 25 is disposed under the finger pressing unit 24 in the printing finger inserting unit 20*a*.

The finger placement unit 25 is a plate member.

When the printing finger U1 is inserted into the printing finger inserting unit 20*a*, the lower surface of the printing finger U1 is placed on the upper surface of the plate member of the finger placement unit 25.

In the embodiment, a concave portion 21*a* is provided at the upper surface side of the dividing wall 21 (that is, the bottom surface of the printing finger inserting unit 20*a*) under the finger placement unit 25.

In the concave portion 21*a*, a lifting mechanism 23 which can lift the finger placement unit 25 upward so as to lift up the printing finger U1 inserted in the printing finger inserting unit 20*a* and placed on the finger placement unit 25 is provided.

The lifting mechanism 23 has a mechanism which lifts up the finger placement unit 25 (printing finger U1 placed on the finger placement unit 25) from a lower side to an upper side by expanding or bulging due to the rise in oil pressure or air pressure, for example. The lifting mechanism 23 is lowered in a state where the oil pressure or air pressure decreases, and contained in the concave portion 21*a* to be nearly flush with the upper surface of the dividing wall 21.

The lifting operation of the lifting mechanism 23 is controlled by an after-mentioned lifting control unit 513 (see FIG. 9) of the control device 50. The lifting mechanism 23 is controlled by the lifting control unit 513 to lift up the finger placement unit 25 until the upper surface of the printing finger U1 which is inserted into the printing finger inserting unit 20*a* and placed on the finger placement unit 25 contacts the lower surface of the finger pressing unit 24 and is pressed against the lower surface of the finger pressing unit 24.

Here, a period of time which is required for making the upper surface of a printing finger U1 with a general thickness contact the lower surface of the finger pressing unit 24 from the start of the lifting operation of the finger placement unit 25 by the lifting mechanism 23 is previously set as a setting time, and the lifting control unit 513 controls so that the lifting mechanism 23 performs the operation of lifting the finger placement unit 25 for the setting time.

Alternatively, for example, a sensor (for example, pressure sensor, touch sensor and pressure-sensitive switch) detecting the contact of the printing finger U1 with the finger pressing unit 24 may be provided and the lifting control unit 513 may control so as to stop the lifting of the finger placement unit 25 by the lifting mechanism 23 when the sensor of the finger pressing unit 24 detects that the printing finger U1 contacts the finger pressing unit 24.

In the embodiment, the nail T is held at the height suitable for printing by the print head 46 in a state where the printing finger U1 is lifted up by the lifting mechanism 23 and the upper surface of the printing finger U1 is pressed against the lower surface of the finger pressing unit 24.

The configuration of the lifting mechanism 23 is not limited to the example illustrated here as long as it can lift up and lower the printing finger U1 inserted into the printing finger inserting unit 20*a* and placed on the finger placement unit 25.

For example, the lifting mechanism 23 may not be controlled by the lifting control unit 513, and a plate supporting the printing finger U1 from the downside and such like may be provided so that the printing finger U1 is lifted up and lowered by a user moving the plate and such like up and down by hand.

Alternatively, the lifting mechanism 23 may have a configuration in which one or a plurality of spring is provided under the finger placement unit 25. In such case, when the printing finger U1 is not inserted into the printing finger inserting unit 20*a*, the finger placement unit 25 is lifted up toward the finger pressing unit 24 in a state where the spring is stretched. Then, when the printing finger U1 is inserted into the printing finger inserting unit 20*a*, the spring is compressed by the own weight of the printing finger U1, and the finger placement unit 25 is pressed down toward the dividing wall 21. Thus, the upper surface of the printing finger U1 on the finger placement unit 25 contacts the lower surface of the finger pressing unit 24 and is pressed against the lower surface of the finger pressing unit 24.

A nail placement unit 26 on which only the tip of the nail T of the printing finger U1 inserted into the printing finger inserting unit 20*a* is placed is arranged in the back of the finger placement unit 25 (the back in the finger inserting direction, the right side of FIG. 4) inside the printing finger inserting unit 20*a*.

The nail placement unit 26 is formed of a material which is flexible to some extent such as rubber and resin, for example.

The material forming the nail placement unit 26 is not limited to the example illustrated here. As the material forming the nail placement unit 26, a preferable one is a material which is not transformed by ink adhesion, and further a material which has some flexibility so as not to place a burden on the fingertip and such like when the nail T is placed thereon.

When the upper surface of the printing finger U1 contacts the lower surface of the finger pressing unit 24 and is pressed against the lower surface of the finger pressing unit 24, the root of the printing finger U1 is pressed downward and the position thereof in the height direction is fixed. However, the vertical position of the tip (fingertip) of the printing finger U1 including the nail T varies according to the degree of bending of the finger and such like. Thus, the position in the height direction of the nail T cannot be fixed only by the finger pressing unit 24.

For example, when the distal end of the printing finger U1 applies a downward force, the nail T is lowered. On the other hand, when the distal end of the printing finger U1 is pulled back, the nail T is raised.

In order to perform a high-accurate printing, a predetermined distance suitable for printing needs to be maintained between the print head 46 and the upper surface of the nail T. Fine printing cannot be performed when the nail T is located too high nor too low. Furthermore, when the fingertip is not stable, the nail T moves up and down even during printing and a position gap may be generated.

As described later, in a case where the form recognition of nail T (that is, detection of the outline of nail T) is performed on the basis of the nail image photographed with the camera 32, when the nail T is located high and close to the camera 32 having the distance therebetween shorter than a predetermined distance, the nail T is recognized as larger than its actual size in some cases. In such case, when printing is performed on the basis of the recognized size, the print range is out of the nail T and ink adheres to the finger or such like.

On the other hand, when the nail T is located low and far away from the camera 32 having the distance therebetween longer than a predetermined distance, the nail T is recognized as smaller than its actual size in some cases. In such case, when printing is performed on the basis of the recognized size, the print range is smaller than the nail T and an uncoated area is generated.

With respect to this, when only the tip of nail T is placed on the nail placement unit 26, the nail T can be stable, the position in the height direction of nail T can be fixed to be constant, and a predetermined distance suitable for printing can be maintained between the print head 46 and the upper surface of the nail T.

As shown in FIG. 4, for example, the upper surface of the nail placement unit 26 and the lower surface of the finger pressing unit 24 are set to be a nearly same plane (that is, have a nearly same height) in the embodiment.

The height, size and such like of the nail placement unit 26 are not limited to the illustrated example. However, when the upper surface of the nail placement unit 26 is too high compared to the height of the lower surface of the finger pressing unit 24, the fingertip portion which is distal to the portion regulated by the finger pressing unit 24 needs to be pulled back largely in order to place the tip of the nail T on the nail placement unit 26, which requires an awkward position on the user.

Thus, it is preferable that the height of the upper surface of the nail placement unit 26 does not exceed the height of the lower surface of the finger pressing unit 24.

In the embodiment, a narrow portion 26*a* which is narrower than a general nail T in the width direction is provided at the front side (left side in FIG. 4) in the finger inserting direction of the nail placement unit 26. The narrow portion 26*a* is a portion in the nail placement unit 26 on which the nail T is placed.

The nail T has a shape which is curved in the width direction, and the size in the width direction of the nail T and the curvature value corresponding to the curvature degree in the width direction vary among individuals and vary by the type of finger (for example, thumb or index finger) even within the same individual. In the embodiment, the height of the top part of the nail T can be set to be nearly constant even when the size and curvature value in the width direction of the nail T vary as described above.

Figure 5A:
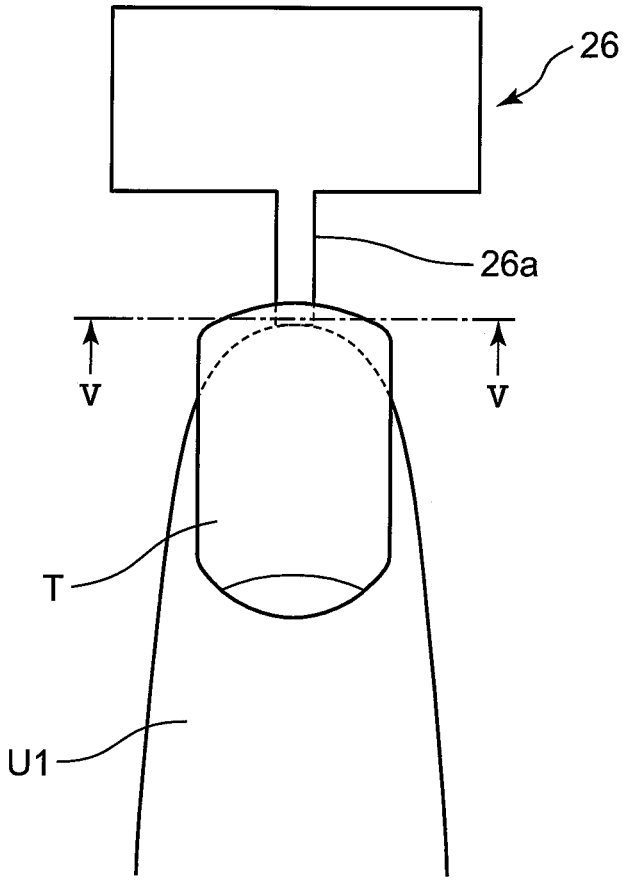
FIG. 5A is a plan view of a state where a tip of a nail with a relatively large curvature is placed on a narrow portion of a nail placement unit, seen from above.

FIG. 5A is a plan view of a state where a tip of a nail T which is in a nearly square shape in the upper surface view and has a relatively large curvature is placed on the upper surface of the narrow portion 26*a* of the nail placement unit 26 of the embodiment, seen from above.

Figure 5B:
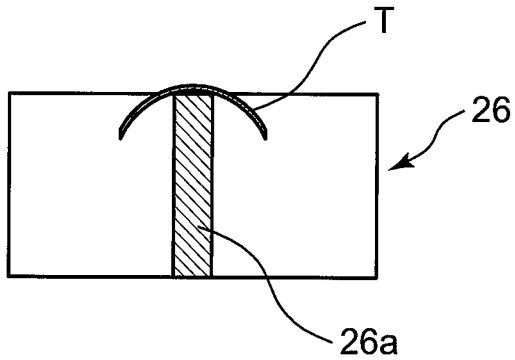
FIG. 5B is a sectional view of FIG. 5A cut along the line V-V, seen from the arrow direction.

FIG. 5B is a sectional view of FIG. 5A cut along the line V-V and seen from the arrow direction.

Figure 6A:
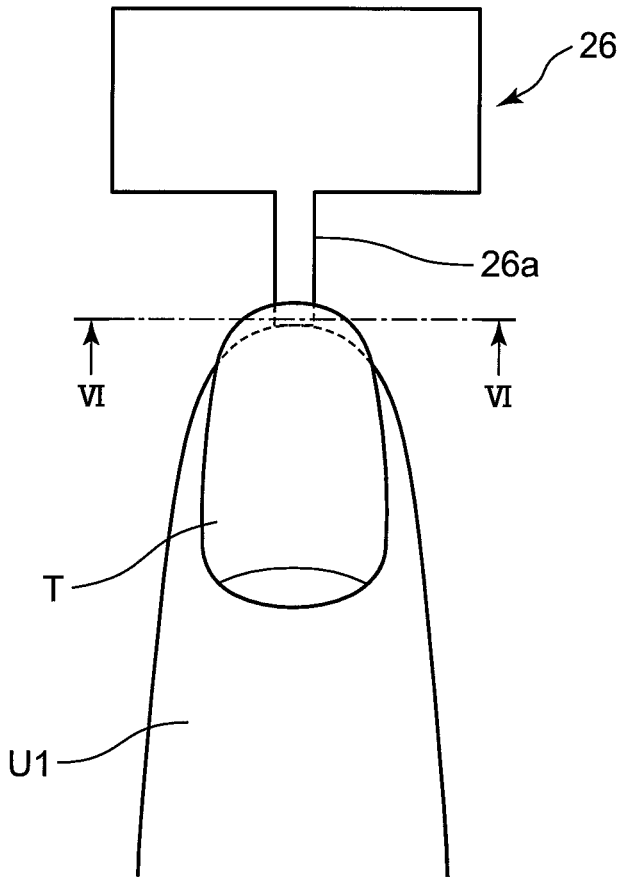
FIG. 6A is a plan view of a state where a tip of a nail with a relatively small curvature is placed on the narrow portion of the nail placement unit, seen from above.

FIG. 6A is a plan view of a state where a tip of a nail T which has a relatively small curvature is placed on the upper surface of the narrow portion 26*a* of the nail placement unit 26, seen from above.

Figure 6B:
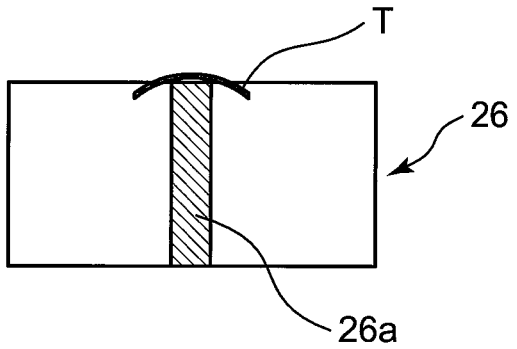
FIG. 6B is a sectional view of FIG. 6A cut along the line VI-VI, seen from the arrow direction.

FIG. 6B is a sectional view of FIG. 6A cut along the line VI-VI and seen from the arrow direction.

Figure 7A:
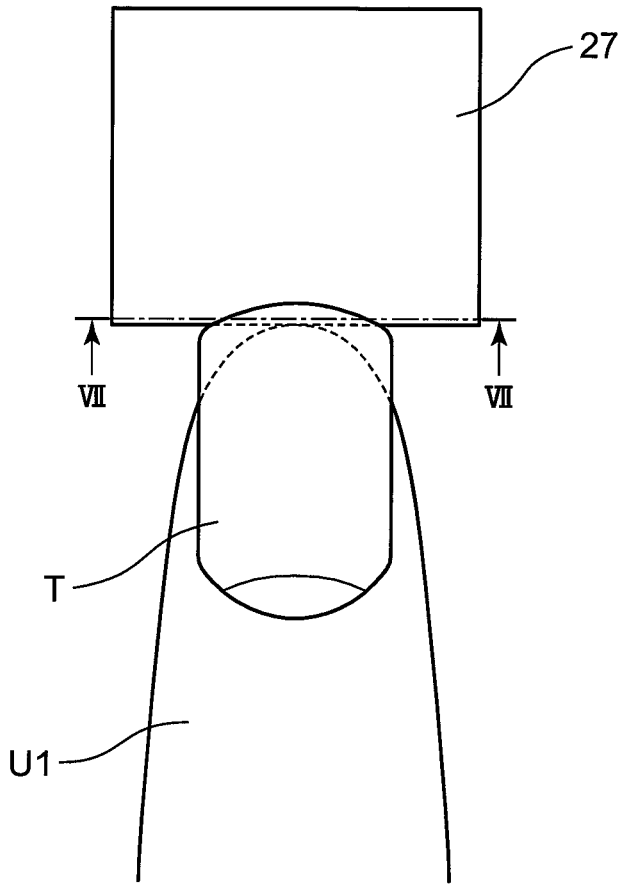
FIG. 7A is a plan view of a state where a tip of a nail with a relatively large curvature is placed on a nail placement unit which is wider than the width of the nail, seen from above.

FIG. 7A is a plan view of a state where a tip of the nail T which is in the nearly square shape and has a relatively large curvature in the upper surface view is placed on the upper surface of a nail placement unit 27 which does not have the narrow portion and is wider than the nail T in the width direction.

Figure 7B:
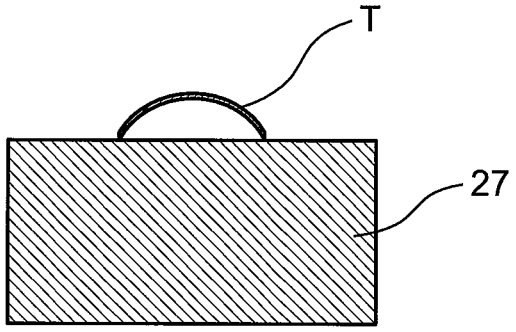
FIG. 7B is a sectional view of FIG. 7A cut along the line VII-VII, seen from the arrow direction.

FIG. 7B is a sectional view of FIG. 7A cut along the line VII-VII and seen from the arrow direction.

Figure 8A:
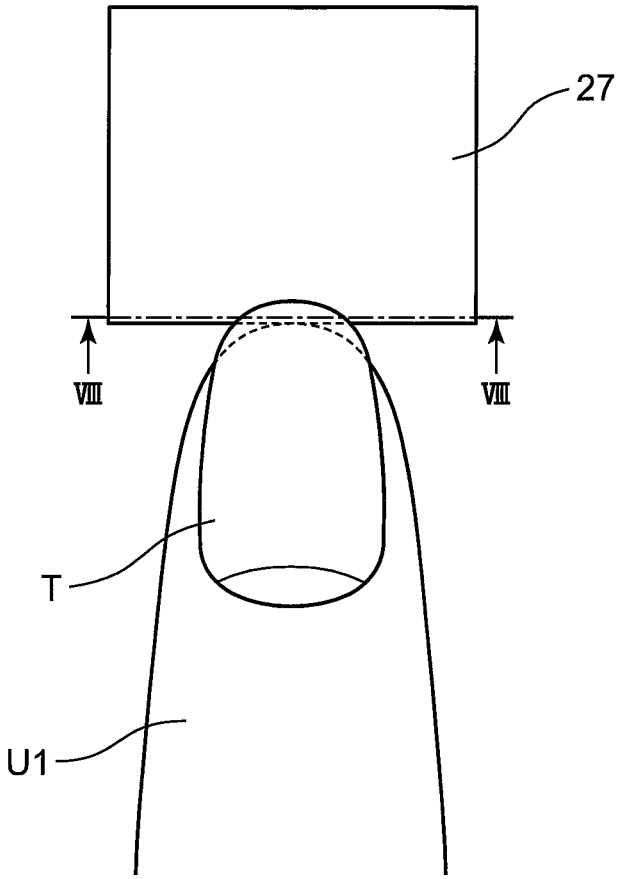
FIG. 8A is a plan view of a state where a tip of a nail with a relatively small curvature is placed on the nail placement unit which is wider than the width of the nail, seen from above.

FIG. 8A is a plan view of a state where a tip of the nail T which has a relatively small curvature is placed on the upper surface of a nail placement unit 27 which does not have the narrow portion and is wider than the nail T in the width direction, seen from above.

Figure 8B:
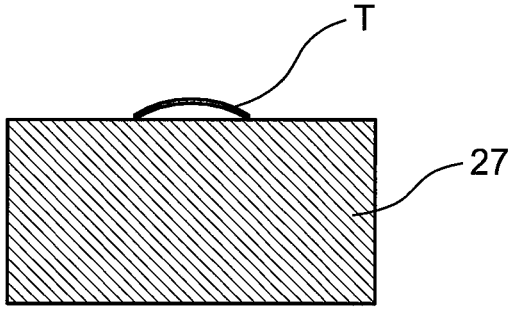
FIG. 8B is a sectional view of FIG. 8A cut along the line VIII-VIII, seen from the arrow direction.

FIG. 8B is a sectional view of FIG. 8A cut long the line VIII-VIII and seen from the arrow direction.

Here, FIGS. 7A, 7B, 8A and 8B are comparative examples with respect to the embodiment.

For example, in a case where the tip of the nail T is placed on the upper surface of the nail placement unit 27 which does not have the narrow portion and is wider than the width size of the nail T as shown in FIGS. 7A, 7B, 8A and 8B, both ends in the width direction of a protruding portion which is protruding from the finger portion at the distal side of the nail T is placed on the upper surface of the nail placement unit 27, the central portion in the width direction of the protruding portion does not contact the upper surface of the nail placement unit 27, and thus the central portion is raised from the upper surface of the nail placement unit 27.

Thus, as shown in FIGS. 7B and 8B, the height of the top part (corresponding to the central portion in the width direction) of the nail T is largely different between the nail T with a large curvature and the nail T with a small curvature.

With respect to this, as shown in FIGS. 5A, 5B, 6A and 6B, in a case where a portion to place the nail T in the nail placement unit 26 is the narrow portion 26*a* which is narrower than the size in the width direction of the area protruding from the finger portion at the distal side of the nail T, only a central area which is a part of the protruding portion protruding from the finger portion at the distal side of the nail T, inside the both ends in the width direction of the protruding portion and including the center in the width direction is placed on the upper surface of the narrow portion 26*a* of the nail placement unit 26. Since the nail placement unit 26 is formed of a material having a flexibility to some extent, when a part of the protruding portion of the nail T is placed on the upper surface of the narrow portion 26*a* of the nail placement unit 26, the narrow portion 26*a* is deformed along the shape of the protruding portion of the nail T. Thus, the central area in the width direction in the protruding portion of the nail T nearly contacts the upper surface of the narrow portion 26*a* of the nail placement unit 26.

Thus, as shown in FIGS. 5B and 6B, the nail T can be held so as to have a nearly same height at the top part thereof even when the nail T has a different size in the width direction and a different curvature value.

The nail placement unit 26 becomes dirty due to ink and such like when performing printing on the nail T. Thus, it is preferable that the nail placement unit 26 is configured to be replaceable.

The replacement method for replacing the nail placement unit 26 is not especially limited. For example, an outlet (not shown in the drawings) which is openable and closable may be provided at a part of the bottom surface (that is, dividing wall 21) of the printing finger inserting unit 20*a* or a wall surface in the back of the printing finger inserting unit 20*a* so that the nail placement unit 26 can be removed and replaced through the outlet.

A cover member (not shown in the drawings) which covers the upper surface of the nail placement unit 26 and such like may be further provided and only the cover member may be replaced.

In such way, by making the nail placement unit 26 or the cover member replaceable, the dirty part can be replaced with a new one when the nail placement unit 26 becomes dirty due to ink or such like, the inside of the apparatus can be held clean and the fingertip and such like can be also prevented from getting dirty due to ink adhesion.

In the embodiment, by inserting the printing finger U1 into the printing finger inserting unit 20*a*, inserting the non-printing fingers into the non-printing finger inserting unit 20*b* and sandwiching the dividing wall 21 between the printing finger U1 and the non-printing fingers, the printing finger U1 is fixed in a stable condition.

For example, in a case where the thumb is the printing finger U1, the thumb (printing finger U1) is inserted into the printing finger inserting unit 20*a* and the four fingers (index finger, middle finger, ring finger and little finger) other than the thumb are inserted into the non-printing finger inserting unit 20*b*. In this case, by the user sandwiching the dividing wall 21 between the printing finger U1 and the non-printing fingers, the printing finger U1 is fixed in a stable condition.

As for the end portion of the dividing wall 21 from where the finger is inserted, the preferable cross-sectional shape in the finger inserting direction of the end portion of the dividing wall 21 is a circle, an oval, a polygon and such like which is naturally fitted when contacting the bases of the printing finger U1 and the non-printing fingers so as not to strain the bases of the fingers even when the dividing wall 21 is held firmly between the printing finger U1 and the non-printing fingers.

As shown in FIGS. 2 to 4, the photographing unit 30 is provided on the upper machine casing 11*b*.

That is, a substrate 15 is set on the upper machine casing 11*b*, and a camera 32 as a photographing device is set at the central portion of the lower surface of the substrate 15.

It is preferable that the camera 32 includes a built-in driver and has approximately two million pixels or more, for example.

The camera 32 photographs the nail T of the printing finger U1 inserted into the printing finger inserting unit 20*a* to obtain a nail image (a finger image including the nail image) which is an image of the nail T of the printing finger U1.

On the substrate 15, lights 33 such as white LEDs are set so as to surround the camera 32. The lights 33 illuminate the nail T of the printing finger U1 at photographing by the camera 32. The photographing unit 30 is configured by including the camera 32 and the lights 33.

In the embodiment, an after-mentioned nail information detecting unit 512 detects the outline of the nail T (the shape of the nail T) as nail information on the basis of the nail image obtained by the camera 32 as the photographing device.

The photographing unit 30 is connected to an after-mentioned photographing control unit 511 (see FIG. 9) in the control device 50 and controlled by the photographing control unit 511.

Image data of the image obtained by the photographing unit 30 is stored in a nail image storage area 521 of an after-mentioned storage unit 52.

The printing unit 40 is mainly provided in the upper machine casing 11*b*.

That is, as shown in FIGS. 3 and 4, two guide rods 41 are bridged in parallel to each other between the both side boards of the upper machine casing 11*b*.

A main carriage 42 is slidably set at the guide rods 41.

As shown in FIG. 4, two guide rods 44 are bridged in parallel to each other between a front wall 42*a* and a rear wall 42*b* of the main carriage 42.

A secondary carriage 45 is slidably set at the guide rods 44. Print heads 46 are mounted on the central portion of the lower surface of the secondary carriage 45.

In the embodiment, each of the print heads 46 is an ink-jet type print head which makes ink be in the form of micro droplets and directly sprays the ink droplets onto a printing surface which is a target of printing to perform printing.

The recording method of the print heads 46 is not limited to the ink-jet type. For example, a printing tool such as a ball-point pen type and a felt pen type may be used to directly contact the printing surface which is the target of printing and perform drawing on the printing surface.

In the embodiment, the printing unit 40 is provided with the print heads 46 corresponding to ink of yellow (Y), magenta (M) and cyan (C), for example.

Each of the print heads 46 includes a nozzle array formed of a plurality of nozzles spraying ink of its color.

The print head 46 provided in the printing unit 40 is not limited to the print heads 46 spraying ink of the three colors. A print head 46 spraying ink of another color may be further provided.

The print heads 46 print an image (nail design) on the surface of the nail T of the printing finger U1 in a state where the upper surface of the printing finger U1 contacts the lower surface of the finger pressing unit 24 and is pressed against the lower surface of the finger pressing unit 24 and at least tip of the nail T is placed on the nail placement unit 26.

The print heads 46 perform printing on the nail T of the printing finger U1 on the basis of the nail information detected by the after-mentioned nail information detecting unit 512.

Ink cartridges 48 for supplying ink to the print heads 46 are provided in the lower machine casing 11*a*.

The ink cartridges 48 are connected to the print heads 46 via an ink supply tube (not shown in the drawings) to appropriately supply ink to the print heads 46. Here, the configuration may be such that the ink cartridges are mounted on the print heads 46 themselves.

The main carriage 42 is joined to a motor 43 via a power transmission unit (not shown in the drawings) and is configured to move to the left and right (left and right in FIG. 3) of the nail print apparatus 1 along the guide rods 41 by the forward-reverse rotation of the motor 43.

The secondary carriage 45 is joined to a motor 47 via a power transmission unit (not shown in the drawings) and is configured to move back and forth (left and right in FIG. 4) along the guide rods 44 by the forward-reverse rotation of the motor 47 in the nail print apparatus 1.

The printing unit 40 is configured by including the guide rods 41, the main carriage 42, the motor 43, the guide rods 44, the secondary carriage 45, the print heads 46, the motor 47, the ink cartridges 48 and others.

The motor 43, the print heads 46 and the motor 47 of the printing unit 40 are connected to an after-mentioned print control unit 514 of the control device 50 and controlled by the print control unit 514.

The control device 50 is set on the substrate 15 disposed on the upper machine casing 11*b* and the like, for example.

Figure 9:
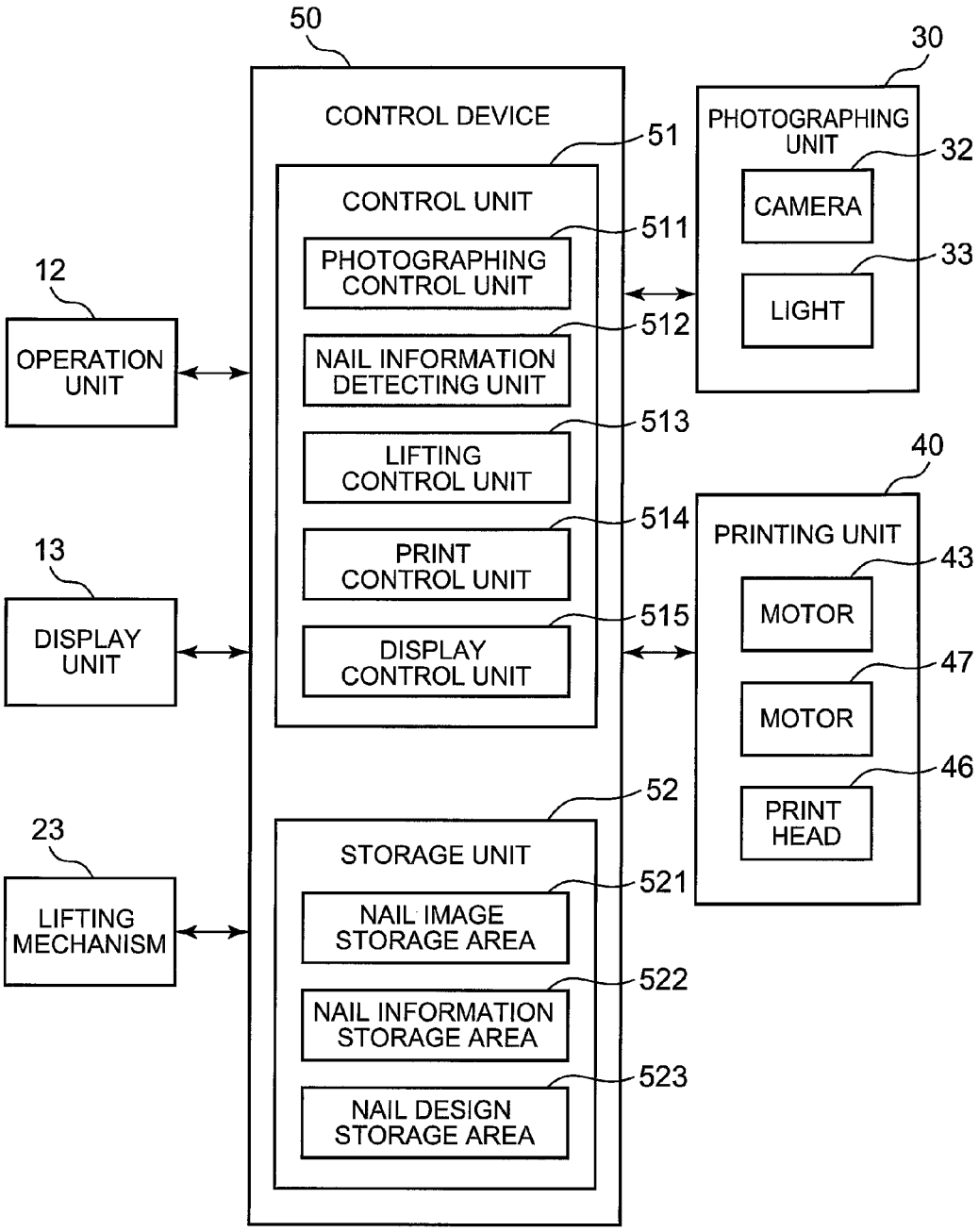
FIG. 9 is a main part block diagram showing a control structure of the nail print apparatus according to the embodiment.

FIG. 9 is a main part block diagram showing a control structure in the embodiment.

As shown in FIG. 9, the control device 50 is a computer which includes a control unit 51 having a CPU (Central Processing Unit) and such like and a storage unit 52 having a ROM (Read only memory), a RAM (Random access memory) and such like which are not shown in the drawings.

Various programs for operating the nail print apparatus 1 and various data are stored in the storage unit 52.

Specifically, in the storage unit 52, various programs such as a nail information detecting program for detecting nail information of the nail T and a printing program for performing a printing process are stored, for example, and the control device 50 executes the programs to control the units of the nail print apparatus 1.

In the embodiment, the storage unit 52 is provided with a nail image storage area 521 for storing a nail image of the nail T of the printing finger U1 of the user obtained by the photographing unit 30, a nail information storage area 522 for storing nail information (outline of nail in the embodiment) detected by the nail information detecting unit 512 and a nail design storage area 523 for storing image data of nail designs to be printed on the nail T.

The nail design image data stored in the nail design storage area 523 is data which is rectangular and larger than the size of a general nail T so as to correspond to the sizes of various types of nail Ts, for example.

In a functional view, the control unit 51 includes functional units such as the photographing control unit 511, the nail information detecting unit 512, the lifting control unit 513, the print control unit 514 and the display control unit 515.

The functions as the photographing control unit 511, the nail information detecting unit 512, the lifting control unit 513, the print control unit 514 and the display control unit 515 are achieved in cooperation between the CPU of the control unit 51 and the programs stored in the ROM and such like of the storage unit 52. The functional units included in the control unit 51 are not limited to the above examples.

The photographing control unit 511 controls the photographing unit 30 to photograph the printing finger U1 of the user and obtains the nail image of the nail T (finger image including the nail image).

The nail image obtained by the photographing unit 30 is stored in the nail image storage area 521 of the storage unit 52.

When the user inserts the printing finger U1 into the printing finger inserting unit 20*a*, the photographing control unit 511 may make the photographing unit 30 photograph the appearance of the printing finger U1 which is being inserted into the printing finger inserting unit 20*a*.

In this case, by displaying the image photographed by the photographing unit 30 on the display unit 13 or such like, when setting the printing finger U1, the user can visually confirm the location of the printing finger U1 easily and place the tip of the nail T of the printing finger U1 on the nail placement unit 26 appropriately, which is preferable.

The nail information detecting unit 512 detects the nail information for the nail T of the printing finger U1 on the basis of the nail image obtained by the camera 32 which is the photographing device.

In the embodiment, the nail information detecting unit 512 detects the outline of the nail T (nail shape) as the nail information.

Specifically, the nail information detecting unit 512 detects the outline (shape) and location of the nail T from the finger image which includes the nail image of the nail T of the printing finger U1 obtained by the camera 32, and obtains the outline as information represented by x and y coordinates and such like.

The method of detecting the outline (shape) of the nail T by the nail information detecting unit 512 is not especially limited.

For example, the nail information detecting unit 512 detects the outline (shape) of the nail T on the basis of the difference in color and such like between the nail T and the other finger portion from the finger image including the nail image of the nail T of the printing finger U1 obtained by the camera 32.

The method of detecting the outline (shape) of the nail T by the nail information detecting unit 512 is not especially limited and not limited to the above examples.

The nail information detecting unit 512 is not limited to the nail information detecting unit which detects only the outline (shape of the nail T) of the nail T as the nail information.

For example, the nail information detecting unit 512 may also detect the height of nail T (position in vertical direction of the nail T) and the curvature of nail T (nail curvature).

In this case, a plurality of nail images are obtained by photographing the nail T of the printing finger U1 with the camera 32 from a plurality of different angles, and the height and curvature of the nail T are detected on the basis of the obtained nail images, for example.

In a case where the nail information detecting unit 512 also detects the height of nail T and the curvature of nail T, printing can be performed also in consideration of the shape of the nail T in the height direction, which can achieve more highly accurate printing.

The lifting control unit 513 is a functional unit which lifts and lowers the printing finger U1 inserted into the printing finger inserting unit 20*a* by controlling the operation of the lifting mechanism 23.

In the embodiment, the lifting control unit 513 lifts up the printing finger U1 which is placed on the upper surface of the finger placement unit 25 and holds the printing finger U1 at the position where the upper surface of the printing finger U1 contacts the lower surface of the finger pressing unit 24 during printing.

The print control unit 514 outputs the print data based on the nail design image data to the print heads 46 of the printing unit 40 and controls the printing unit 40 so as to perform printing on the nail T with the print heads 46 according to the print data.

In the embodiment, the control unit 51 fits the nail design image data selected by the user operating the operation unit 12 or the like into the outline of the nail T detected by the nail information detecting unit 512 and generates print data that the area inside the outline of the nail T detected by the nail information detecting unit 512 is a printing target area, and the print control unit 514 outputs the print data to the print heads 46.

As described above, in the embodiment, the nail design image data stored in the nail design storage area 523 is data which is rectangular and large, and the print data is generated by performing the fitting process of appropriately reducing the nail design image data into the outline of the nail T, for example.

The specific method of the fitting process is not especially limited. For example, among the longitudinal and lateral lengths of the nail T which is the printing target, the shorter one is a reference, and the nail design image data is reduced into a size such that the nail design is not out of the nail T, and thereby fitted into the area inside the outline of nail T to generate the print data.

The display control unit 515 controls the display unit 13 to display various display screens.

In the embodiment, for example, the display control unit 515 displays a finger image obtained by photographing the printing finger U1, a nail image (an image such as the outline of nail T) included in the finger image, a design selection screen for selecting the image (that is, the "nail design") to be printed on the nail T, thumbnail images for design confirmation and instruction screens for displaying various instructions on the display unit 13.

Figure 10:
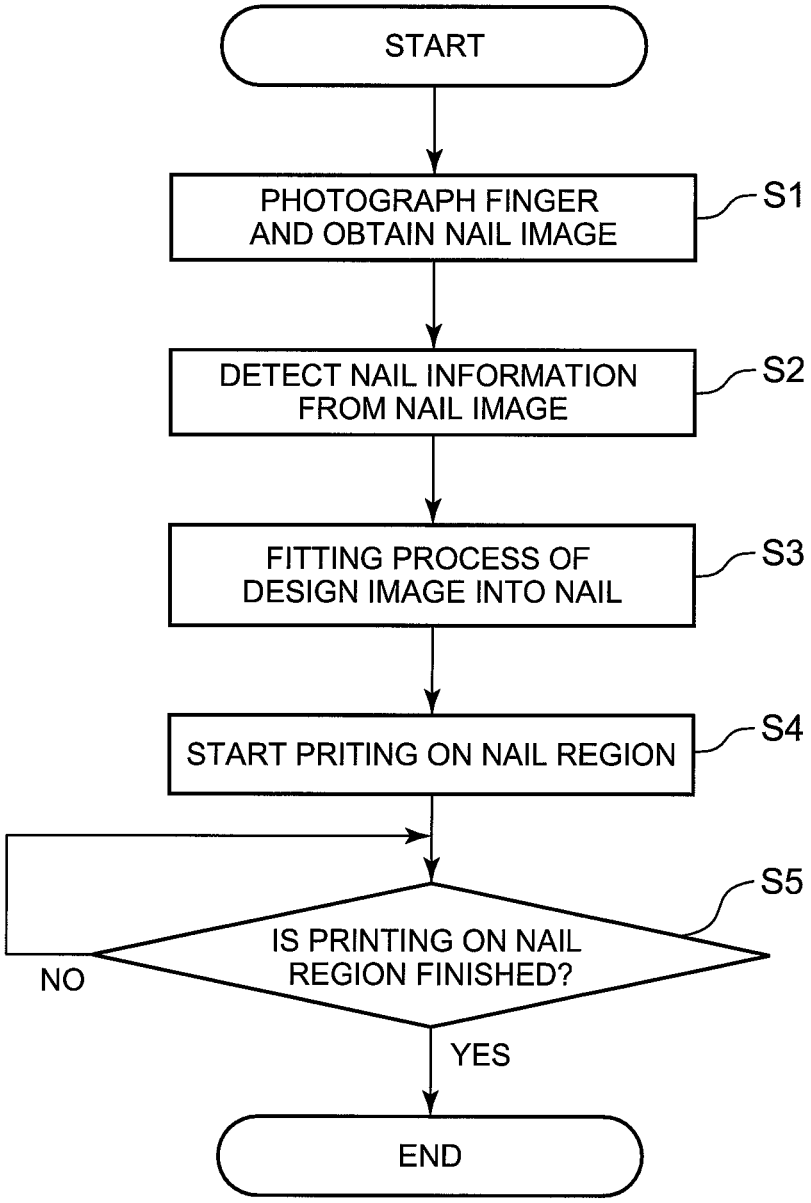
FIG. 10 is a flowchart showing a printing process in the embodiment.

Next, with reference to FIGS. 10 and 11, for example, a printing method by the nail print apparatus 1 in the embodiment will be described.

When performing printing by the nail print apparatus 1, the user turns on the power switch to activate the control device 50, first.

The display control unit 515 displays the design selection screen on the display unit 13, the user operates operation buttons 121 and such like of the operation unit 12 to select the desired nail design among a plurality of nail designs displayed on the design selection screen, and thus, a selection instruction signal is output from the operation unit 12 to determine a single nail design.

Then, as shown in FIG. 11A, the user inserts the printing finger U1 onto the finger placement unit 25 of the printing finger inserting unit 20*a* along the finger inserting direction (indicated by the arrow in FIG. 11A) and as shown in FIG. 11B, inserts the printing finger U1 deeply so that the nail T contacts the nail placement unit 26. Thus, the printing finger U1 is positioned in the depth direction.

When the setting of the printing finger U1 onto the finger placement unit 25 is completed, the lifting control unit 513 operates the lifting mechanism 23 to lift up the printing finger U1 together with the finger placement unit 25.

As shown in FIG. 11C, the lifting mechanism 23 moves upward to the position where the upper surface of the printing finger U1 contacts the lower surface of the finger pressing unit 24, and stops. Thus, the printing finger U1 is sandwiched between the finger placement unit 25 and the finger pressing unit 24 and positioned at the height suitable for printing.

In this state, the user places the tip of the nail T on the narrow portion 26*a* of the nail placement unit 26. At that time, the nail tip is more stable by being pressed downward to some extent, which is preferable.

The curvature of the nail T varies among the individuals and varies by the type of printing finger U1 even in the same individual. However, these differences in curvature of nail T in the width direction of the printing finger U1 are absorbed by placing the tip of the nail T on the narrow portion 26*a*, and the position of the top part of the nail T can be at the nearly same height even when the curvature of the nail T of the printing finger U1 varies.

Furthermore, the thickness of the printing finger U1 also varies among individuals and varies by the type of the printing finger U1 even in the same individual. However, these differences in thickness of printing finger U1 are also absorbed by the upper surface of the printing finger U1 contacting the lower surface of the finger pressing unit 24 and being pressed against the lower surface of the finger pressing unit 24, and the position of the top part of the nail T can be at the nearly same height even when the thickness of the printing finger U1 varies.

Next, the photographing control unit 511 controls the photographing unit 30 to photograph the nail T of the printing finger U1 and obtains the nail image (step S1).

When the nail image is obtained, the nail information detecting unit 512 detects the nail shape (outline of nail T) as nail information from the nail image (step S2).

When the outline of nail T is detected, the control unit 51 performs the fitting process of the nail design image data into the outline of the nail T detected by the nail information detecting unit 512 (step S3).

Thus, the print data that the area inside the outline of the nail T detected by the nail information detecting unit 512 is the printing target area is generated.

When the print data is generated, the print control unit 514 outputs the print data to the print heads 46 and starts the printing on the nail region based on the print data (that is, the area inside the outline of nail T detected by the nail information detecting unit 512) (step S4).

The print control unit 514 determines whether the printing on the nail region is finished (step S5), and if the printing is not finished (step S5; NO), repeats the process until the printing is finished.

If the printing on the nail region is finished (step S5; YES), the printing process on the nail T is finished.

In a case where another nail T of finger is to be printed, the printing finger U1 is replaced and the above process is repeated.

As described above, according to the embodiment, the nail print apparatus includes a nail placement unit 26 to place at least the tip of the nail T of the printing finger U1 which is inserted into the printing finger inserting unit 20*a* and is the finger of the nail T as the printing target, and printing is performed on the nail T in a state where the upper surface of the printing finger U1 contacts the lower surface of the finger pressing unit 24 and is pressed against the lower surface of the finger pressing unit 24 and at least the tip of the nail T is placed on the nail placement unit 26.

By the nail placement unit 26, the user can easily determine the position in the height direction of the nail T to be a position at a predetermined height by merely placing or catching the tip of the nail T on the upper surface of the nail placement unit 26. Thus, it is possible to prevent the fingertip from being pulled back to raise the nail T too much or from lowering to lower the nail T.

Thus, the distance between the nail T and each of the print heads 46 can be constant and high-accurate printing can be performed on the nail T without using a special jig nor performing a troublesome setting or such like and regardless of the thickness of the finger, the size of the nail T, the curvature degree of the nail T or such like.

In the embodiment, the lower surface of the finger pressing unit 24 is nearly the same plane (has nearly same height) as the upper surface of the nail placement unit 26. Thus, when placing the nail T on the upper surface of the nail placement unit 26, the user does not need to unnaturally pull back the fingertip or press down the fingertip and can perform positioning of the height of the nail T in a comfortable condition.

Since the nail print apparatus includes the lifting mechanism 23 which lifts and lowers the finger placement unit 25 to place the printing finger U1, the printing finger U1 can be inserted and removed easily by lowering the finger placement unit 25 when the printing finger U1 is inserted and removed and by lifting the finger placement unit 25 to the position where the upper surface of the printing finger U1 is pressed against the finger pressing unit 24 when printing is performed.

The nail information detecting unit 512 detects the outline of the nail T on the basis of the nail image obtained by the camera 32. Thus, the outline of nail T can be detected accurately, which can achieve a beautiful nail print without running off nor uncoated area. Also in this case, since the distance between the camera 32 and the upper surface of the nail T is maintained constant regardless of the curvature, size, shape and such like of the nail T, the form recognition of the nail T (that is, detection of the outline of nail T) can be performed accurately without separately providing a mechanism which performs sensing for the height direction of the nail T.

In the embodiment, a portion to place the nail T in the nail placement unit 26 is the narrow portion 26*a* which is narrower than the size in the width direction of the nail T. Thus, regardless of the curvature, size, shape and such like of the nail T, the height of the nail T can be nearly constant only by placing the nail T on the nail placement unit 26.

Even in a case where the ink ejected onto the nail T from the print heads 46 becomes mistral ink to be floating in the air, since the ink mist mainly attaches to the nail placement unit 26 and is less likely to be dispersed, it is possible to prevent the finger and the inside of the apparatus from getting dirty due to the ink.

Though the embodiment of the present invention has been described above, the present invention is not limited to the embodiment, and it goes without saying that various changes can be made within the scope of the invention.

For example, the embodiment is described by taking, as an example, a case where the narrow portion 26*a* is provided at the front side in the finger inserting direction of the nail placement unit 26; however, the shape of the nail placement unit 26 is not limited to the example illustrated here as long as at least the tip of the nail T can be caught at the nail placement unit 26.

For example, the narrow portion 26*a* may be wider than the illustrated example and may be further narrower than the illustrated example.

For example, the nail placement unit 26 may be formed only of the narrow portion 26*a* which is narrower than the size in the width direction of the nail T.

For example, the nail placement unit 26 may be a rod-like member or include a spherical or hemispherical portion to place the nail T at the distal end of a supporting member such as a rod.

In any case of the above, it is preferable that the height of the upper surface of the portion to place the nail T in the nail placement unit 26 does not exceed the height of the lower surface of the finger pressing unit 24.

More preferably, the upper surface of the portion to place the nail T of the nail placement unit 26 is configured to be nearly as high as the lower surface of the finger pressing unit 24.

In the embodiment, the finger placement unit 25 is disposed inside the finger inserting unit 20*a* and the lifting mechanism 23 lifts and lowers the finger placement unit 25 and the printing finger U1 placed thereon. However, it is not essential to provide the finger placement unit 25 inside the printing finger inserting unit 20*a*.

In a case where the finger placement unit 25 is not provided, the printing finger U1 inserted into the printing finger inserting unit 20*a* may be directly lifted and lowered by the lifting mechanism 23.

The embodiment is described by taking, as an example, a case where the nail image storage area 521, the nail information storage area 522 and the nail design storage area 523 are provided inside the storage unit 52 of the control device 50; however, the present invention is not limited to the case where the nail image storage area 521, the nail information storage area 522 and the nail design storage area 523 are provided in the storage unit 52 (ROM and RAM) of the control device 50, and another storage unit may be provided.

The embodiment is described by taking, as an example, the nail print apparatus 1 in which a finger is inserted into the apparatus one by one to sequentially perform printing. However, the present invention can be applied to an apparatus which can perform printing continuously on a plurality of fingers without removing and inserting each of the fingers.

In such case, nail placement units 26 are prepared by the amount equal to the number of the printing fingers U1 to be inserted. Also, according to the difference in length by the type of finger, the nail placement units 26 may be located so as to be shifted from each other by the type of the finger by, for example, arranging the nail placement unit 26 for a little finger at a relatively front side in the finger inserting direction and arranging the nail placement unit 26 for a middle finger at a relatively back side in the finger inserting direction.

Though several embodiments of the present invention have been described above, the scope of the present invention is not limited to the above embodiments, and includes the scope of inventions, which is described in the scope of claims, and the scope equivalent thereof.

What is claimed is:

1. A nail print apparatus, comprising:

a nail placement unit on which a central area in a protruding portion of a nail of a finger or a nail of a toe is placeable, the protruding portion of the nail being an area that protrudes from a distal portion of the finger or the toe and the central area including a center of the protruding portion in a width direction of the nail;

a print head which performs printing on the nail when the central area of the nail is placed on the nail placement unit;

a lifting mechanism which lifts and lowers the finger or the toe; and a finger pressing unit which is located so that a lower surface thereof is contactable with an upper surface of the finger or the toe, and which regulates a height of the upper surface of the finger or the toe.

2. The nail print apparatus according to claim 1, wherein:

the nail placement unit has a contact area that contacts with an area including the central area in the protruding portion when the central area of the nail is placed thereon, and a size of the contact area in the width direction is smaller than a size of the nail in the width direction.

3. The nail print apparatus according to claim 1, wherein a height of an upper surface of the nail placement unit does not exceed a height of the lower surface of the finger pressing unit.

4. The nail print apparatus according to claim 1, further comprising a finger placement unit on which the finger or the toe is placeable, and wherein the lifting mechanism lifts and lowers the finger placement unit.

5. The nail print apparatus according to claim 1, wherein:

the lifting mechanism lowers the finger or the toe to a first position where the upper surface of the finger or the toe does not contact with the lower surface of the finger pressing unit when the printing by the print head is not performed, and the lifting mechanism lifts the finger or the toe from the first position to a second position where the upper surface of the finger or the toe contacts with the lower surface of the finger pressing unit and is pressed against the lower surface of the finger pressing unit when the printing by the print head is performed.

6. The nail print apparatus according to claim 1, further comprising:

a photographing device which photographs the nail of the finger or the toe and obtains a nail image; and a nail information detecting unit which detects an outline of the nail based on the nail image obtained by the photographing device.

7. A printing method for a nail print apparatus including (i) a nail placement unit on which a central area in a protruding portion of a nail of a finger or a toe is placeable, the protruding portion of the nail being an area which protrudes from a distal portion of the finger or the toe and the central area including a center of the protruding portion in a width direction of the nail, (ii) a print head which performs printing, (iii) a lifting mechanism which lifts and lowers the finger or the toe, and (iv) a finger pressing unit which is located so that a lower surface thereof is contactable with an upper surface of the finger or the toe and which regulates a height of the upper surface of the finger or the toe, said printing method comprising:

operating the lifting mechanism to lower the finger or the toe to a first position where the upper surface thereof does not contact with the lower surface of the finger pressing unit when printing by the print head is not performed;

operating the lifting mechanism to lift the finger or the toe from the first position to a second position where the upper surface of the finger or the toe contacts with the lower surface of the finger pressing unit and is pressed against the lower surface of the finger pressing unit; and operating the print head to perform printing on the nail when the central area is placed on the nail placement unit and the finger or toe is in the second position.

* * * * *